US006186100B1

(12) United States Patent
Sawada

(10) Patent No.: US 6,186,100 B1
(45) Date of Patent: Feb. 13, 2001

(54) VALVE ASSEMBLY FOR INTERNAL COMBUSTION ENGINE

(75) Inventor: Takashi Sawada, Tokyo (JP)

(73) Assignee: Nissan Motor Co., Ltd., Yokohama (JP)

( * ) Notice: Under 35 U.S.C. 154(b), the term of this patent shall be extended for 0 days.

(21) Appl. No.: 09/438,499

(22) Filed: Nov. 12, 1999

(30) Foreign Application Priority Data

Nov. 13, 1998 (JP) ..... 10-324100

(51) Int. Cl.[7] ..... F01L 9/04
(52) U.S. Cl. ..... 123/90.11; 123/90.33
(58) Field of Search ..... 123/90.11, 90.19, 123/90.33

(56) References Cited

U.S. PATENT DOCUMENTS

| | | | | |
|---|---|---|---|---|
| 5,611,303 | * | 3/1997 | Izuo | 123/90.11 |
| 5,645,019 | | 7/1997 | Liang et al. | 123/90.11 |
| 5,720,242 | * | 2/1998 | Izuo | 123/90.11 |
| 5,730,091 | | 3/1998 | Diehl et al. | 123/90.11 |
| 5,832,883 | * | 11/1998 | Bae | 123/90.11 |

FOREIGN PATENT DOCUMENTS 9-256825 9/1997 (JP) .

* cited by examiner

*Primary Examiner*—Weilun Lo
(74) *Attorney, Agent, or Firm*—Foley & Lardner

(57) ABSTRACT

In each engine valve assembly (2) of intake and exhaust valve for an internal combustion engine, the engine valve is opened and closed according to a cooperation of electromagnetic forces and spring forces of a pair of electromagnets (5, 6) and a pair of spring members (7, 8), an actuator housing (3) in which the pair of electromagnets and pair of spring members are housed taking an engine oil structure having at least one oil passage (21) through which an engine oil external to the valve assembly is supplied to the actuator housing and at least one oil outlet hole (22) through which the engine oil in the oil passage is caused to flow onto a slidable portion of movable members of the valve assembly of a valve axle portion of the engine valve and an armature (4) and taking an oil heating structure (23), the oil heating structure being enabled to heat the oil within the oil passage due to a heat transfer action thereof by means of a simultaneous power supply to the pair of first and second electromagnets before an initialization operation of the valve assembly.

15 Claims, 6 Drawing Sheets

VALVE ASSEMBLY FOR INTERNAL COMBUSTION ENGINE

BACKGROUND OF THE INVENTION a) Field of the Invention

The present invention relates to electromechanically actuated valves for an internal combustion engine, and more specifically relates to intake and exhaust valve assemblies used in the internal combustion engine.

b) Description of the Related Art

A Japanese Patent Application First Publication No. Heisei 9-256825 published on Sep. 30, 1997 exemplifies previously proposed intake and exhaust valve assemblies for an internal combustion engine.

In the previously proposed intake and exhaust valve assemblies, an armature integrally linked to each valve axle portion of the corresponding one of the intake and exhaust valves is operated by a cooperation operation of a pair of electromagnets, one electromagnet being energized to direct the valve axle portion in a valve open direction and the other electromagnet being energized to direct the valve axle portion in a valve close direction and both electromagnets being disposed in an actuator housing so as to be faced against upper and lower planes of the armature, respectively, and a pair of spring members, one spring member biasing the valve axle portion of the corresponding one of the intake and exhaust valves in the valve close direction. Consequently, each of the intake and exhaust valve can be opened or closed according to either electromagnetic force exerted by the one or the other of the pair of electromagnets.

SUMMARY OF THE INVENTION

During an engine stop state in which the pair of electromagnets are de-energized (viz. no power supply is received by both of the pair of electromagnets), each of the intake and exhaust valves is open in an intermediate lift state. Hence, it is necessary to initialize each valve assembly (viz., initialization operation) in such a manner that the pair of electromagnets are alternatingly energized or de-energized for each of the intake and exhaust valves to be opened once or to be closed once when the engine is started.

An engine oil is supplied in a mist form as a lubricating oil in each valve assembly. However, if a viscosity of the engine oil stuck to a slide portion of each movable member of the corresponding valve assemblies indicate high during a cold engine start, a friction on the slide portion of each movable member in the corresponding one of the valve assemblies is so high that a power consumption of a vehicular battery becomes increased.

It is, therefore, an object of the present invention to provide an improved valve assembly for an internal combustion engine which can raise the temperature of the engine oil for lubrication supplied to the slide portion of each movable member of the valve assembly prior to the initialization operation of the valve assembly when the engine is started during a cold condition (so-called, during an engine cold start) so as to enable the reduction of the viscosity of the engine oil, thus the friction during the initialization operation being reduced and the power consumption of the vehicular battery being saved.

The above-described object can be achieved by providing an engine valve assembly for an internal combustion engine having a cylinder head, the engine valve assembly comprising: an engine valve having a valve head portion and a valve axle portion, the valve axle being slidably mounted within the cylinder head; an armature having an armature axle portion linked to the valve axle portion of the engine valve; an actuator housing assembled onto the cylinder head; an electromagnetic actuator disposed within the actuator housing and having a pair of first and second electromagnets, each of the first and second electromagnets being vertically extended with respect to an axis direction of the armature axle portion and being contacted on the actuator housing; and a pair of first and second spring members, the first spring member biasing the engine valve toward a valve open direction and the second spring member biasing the engine valve toward a valve closure direction so that the engine valve is open and closed according to a cooperation of forces exerted by the pair of first and second electromagnets and the pair of first and second spring members, the actuator housing taking an engine oil structure having at least one oil passage through which an engine oil external to the valve assembly is supplied to the actuator housing and at least one oil outlet hole through which the engine oil in the oil passage is caused to flow onto a slidable portion of movable members of the valve assembly of the valve axle portion of the engine valve and the armature and taking an oil heating structure, the oil heating structure being enabled to heat the oil within the oil passage due to a heat transfer action thereof by means of a simultaneous power supply to the pair of first and second electromagnets before an initialization operation of the valve assembly.

DETAILED DESCRIPTION OF THE PREFERRED EMBODIMENT

Reference will hereinafter be made to the drawings in order to facilitate a better understanding of the present invention.

Figure 1A:
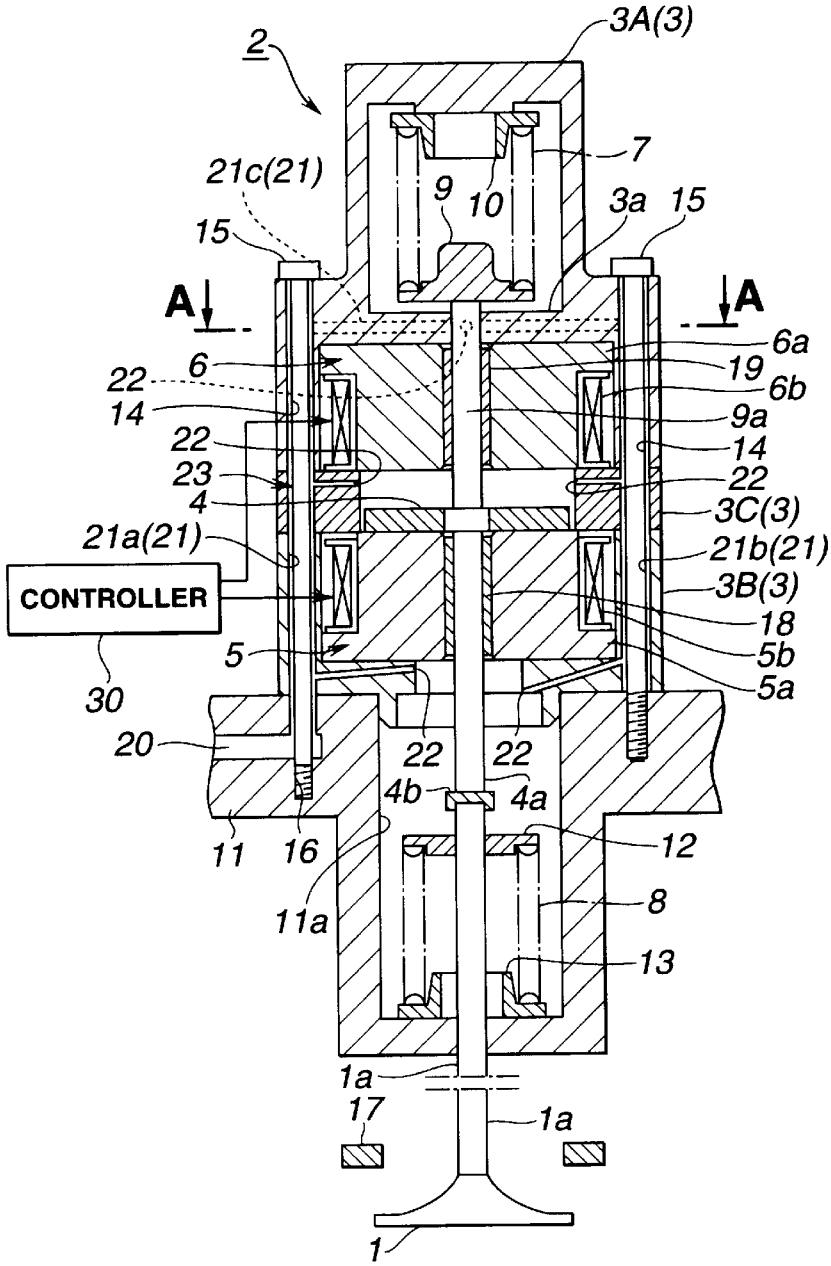
FIG. 1A is a longitudinal cross sectional view of a valve assembly for an internal combustion engine in a preferred embodiment according to the present invention.

FIG. 1A shows a preferred embodiment of an engine valve assembly for an internal combustion engine.

In FIG. 1A, 1 denotes an engine valve body such as an intake valve or exhaust valve and 2 denotes a valve assembly of the valve body 1.

The valve assembly 2 includes: an armature 4 made of a metallic material having a magnetic property and has an axle portion 1*a* of the engine valve 1; a pair of magnetic cores 5*a* and 6*a*; a pair of excitation magnetic coils 5*a* and 6*b* wound on their outer peripheral surfaces of the corresponding magnetic cores 5*a* and 6*a*. The core 5*a* and the excitation magnetic coil 5*b* constitute an electromagnet 5. The other core 6*a* and the other magnetic coil 6*b* constitute another electromagnet 6. The pair of electromagnets 5 and 6 are extended vertically with respect to outer peripheral surfaces of the axle portion 4*a* of the armature 4 and are opposed to each other with a predetermined spatial interval via the armature main body 4. The upper electromagnet 5 serves to slide the axle portion 4*a* of the armature upward to close the valve body 1 when energized. The lower electromagnet 6 serves to slide the axle portion 4*a* of the armature 4 downward to open the valve body 1 when energized. In addition, the valve assembly 2 includes a pair of coil springs 7 and 8 as two spring members to bias the valve axle portion 1*a* in the valve open direction and in the valve closure direction.

When the pair of electromagnets 5 and 6 are de-energized, spring forces exerted by the pair of coil springs 7 and 8 are set at a predetermined balanced position so that the valve body 1 is held at an intermediate lift position. The pair of electromagnets 5 and 6 are set so as to provide electromagnetic forces having magnitudes accommodating to magnitudes of the spring forces exerted by the pair of coil springs 7 and 8. Consequently, the valve body 1 is opened and closed according to a cooperation of the electromagnetic forces exerted by these electromagnets 5 and 6 and spring forces of the coil springs 7 and 8.

The armature 4 includes the axle portion 4*a* fixed at a center position of a lower surface of the armature main body 4. A lower end of the axle portion 4*a* is contacted on a contact 4*b* fitted onto an upper end of the valve axle portion 1*a* to be linked to the valve axle portion 1*a*.

The valve assembly 2 further includes an upper movable spring seat 9 fixed onto a center of an upper surface of the armature 4. A lower end of a spring axle portion 9*a* fixed onto the movable spring seat 9. The coil spring 7 to bias the valve body 1 in the valve open direction is elastically interposed between a stationary spring seat 10 fixed onto an upper wall of the housing 3 and the movable spring seat 9.

The lower coil spring 8 is disposed within a recess 11*a* installed within a cylinder head 11. The lower coil spring 8 is elastically interposed between a movable spring seat 12 fixed onto the valve axle portion 1*a* and a bottom surface of the recess portion 11*a*.

In the embodiment, an actuator housing 3 is formed substantially in a rectangular shape of cross section so as to dispose the valve assembly 2 as compact as possible on the cylinder head 11.

The armature 4 and the pair of electromagnets 5 and 6 are also formed substantially in the rectangular shape of cross section which matches the housing 3 in terms of a projected plane so that these members can be housed smoothly.

In addition, both side portions of the housing 3 in a cylinder row direction provide no side walls so as to be exposed to the air and so as to be enabled to be disposed adjacent to the housing 3 of another cylinder in the cylinder row direction.

Furthermore, the actuator housing 3 is divided into an upper housing 3A housing the upper electromagnet 6 and the coil spring 7 and a lower housing 3B housing the lower electromagnet 5. Then, a distance block 3C is interposed between the upper housing 3A and the lower housing 3C. The distance block 3C serves to integrally fix the upper and lower housings 3A and 3B to position the lower electromagnet 5 housed so as to be contacted on an inner wall portion of the lower housing 3B and to position the upper electromagnet 6 housed so as to be contacted on an inner wall portion of the upper housing 3A, thus a required vertical spatial interval being held between the upper electromagnet 5 and lower electromagnet 6.

Figure 2:
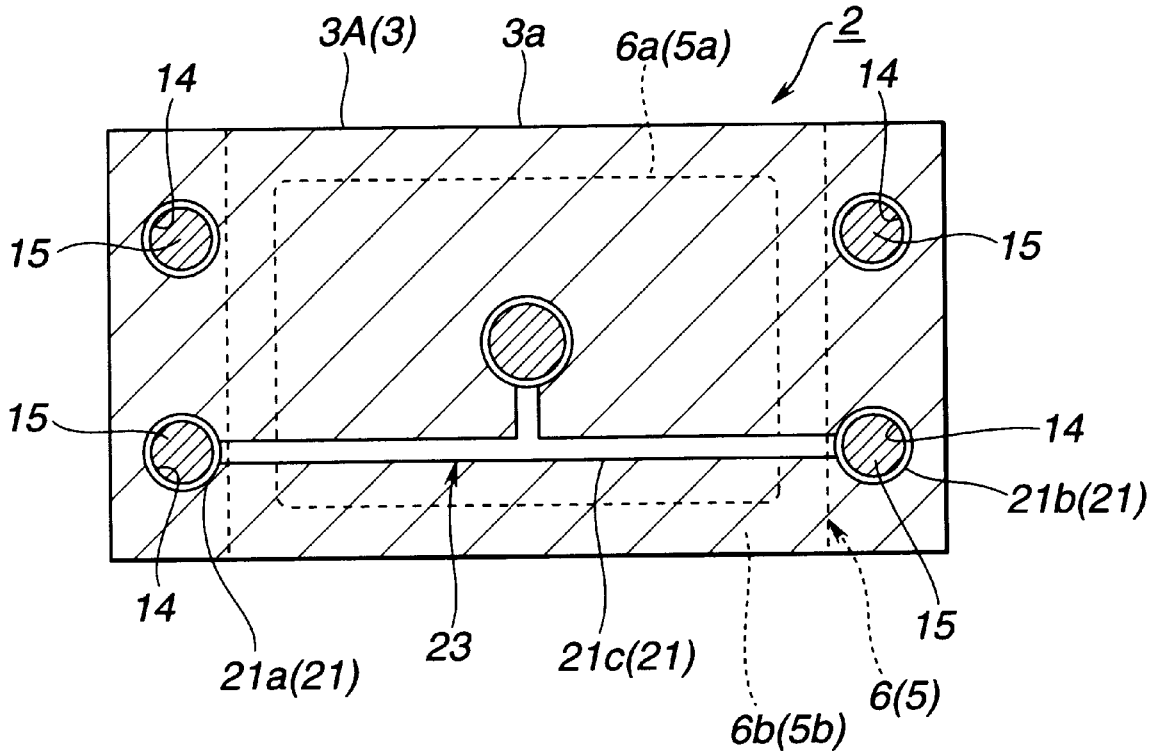
FIG. 2 is a cross sectional view of an actuator housing cut away along a line of A—A shown in FIG. 1A.

A plurality (two) of pairs of bolt holes 14 are penetrated vertically through the upper housing 3A, the distance block 3C, and the lower housing 3B, as shown in FIGS. 1A and 2.

Then, an assembly bolt 15 is inserted into each bolt hole 14 to be screwed into a corresponding screwed hole 16 provided within the cylinder head 11 so that the whole actuator housing 3 is fixed onto the cylinder head 11.

The actuator housing 3 further includes an oil passage structure having an oil passage 21 communicated with an oil passage 20 provided within the cylinder head 11 and through which an engine oil (lubricating oil) is supplied and a plurality of oil outlet holes 22, each oil outlet hole 22 serving to output the engine oil within the oil passage 21 to a slide portion of each movable member in the valve assembly 2.

The actuator housing 3 further includes an oil heating structure 23 which corresponds to the oil passage structure and is enabled to heat the engine oil in the oil passage 21 due to a heat transfer thereof caused by a power supply to the pair of upper and lower electromagnets 5 and 6.

In the embodiment, making an effective use of the oil passage 21 within the actuator housing 3, a clearance between each peripheral surface of the pair of bolt holes 14 and 14 and of the corresponding pair of assembly bolts 15 and 15, the pair of bolt holes 14 and 14 being located on the side walls of the actuator housing 3 and being spaced apart from each other.

Thus, each clearance provides first and second oil branched passages 21*a* and 21*b*, as shown in FIG. 2.

The corresponding bolt hole 14 constituting the first oil branched passage 21*a* and the screw hole 16 of the cylinder head 11 are communicated with the oil passage 20 of the cylinder head 11. The first and second oil branched passage are communicated via a communication passage 21*c*. The communication passage 21*c* is provided on a partitioning wall 3*a* to partition a housing portion of the upper housing 3A for the upper electromagnet 6 and a housing portion for the upper coil housing 7 to bias the valve body 1 in the open direction.

That is to say, in the embodiment shown in FIGS. 1A through 2, the oil passage of the actuator housing 3 is structured in a, so-called, turn flow configuration. The turn flow configuration is such that the engine oil is circulated from the first oil branched passage 21*a* in the upward direction, is passed through the communication passage 21*c*, is circulated into the second oil branched passage 21*b* in the downward direction over disposed regions of the lower electromagnet 5 and the upper electromagnet 6.

The oil outlet hole 22 is disposed to output the engine oil in the oil passage 21 so as to be oriented toward the armature axle portion 4*a*, disposed portions of each bearing 18 and 19 of the spring axle portion 9*a* and of the contact 4*b*.

The valve assembly 2 is operated in response to a power supply control to each of the pair of electromagnets 5 and 6 by means of an engine controller 30. The oil heating structure 23 is heated by a simultaneous power supply to the pair of electromagnets 5 and 6 before an initialization operation of the valve assembly 2 by means of the engine controller 30 when an engine temperature indicates lower than a predetermined temperature.

It is noted that reference numeral 17 in FIG. 1A denotes a valve seat.

Figure 1B:
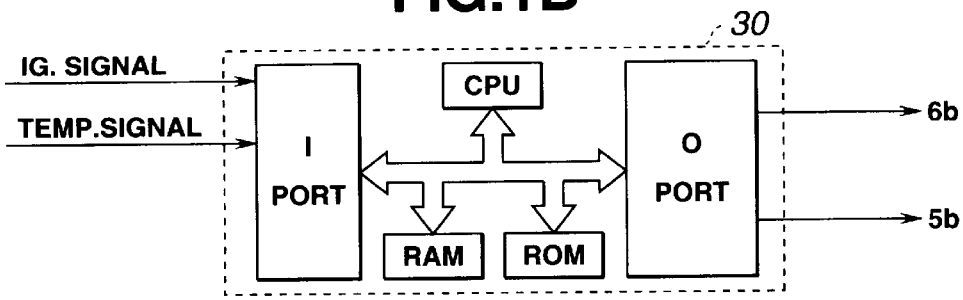
FIG. 1B is a circuit block diagram of an engine controller shown in FIG. 1A.
Figure 3:
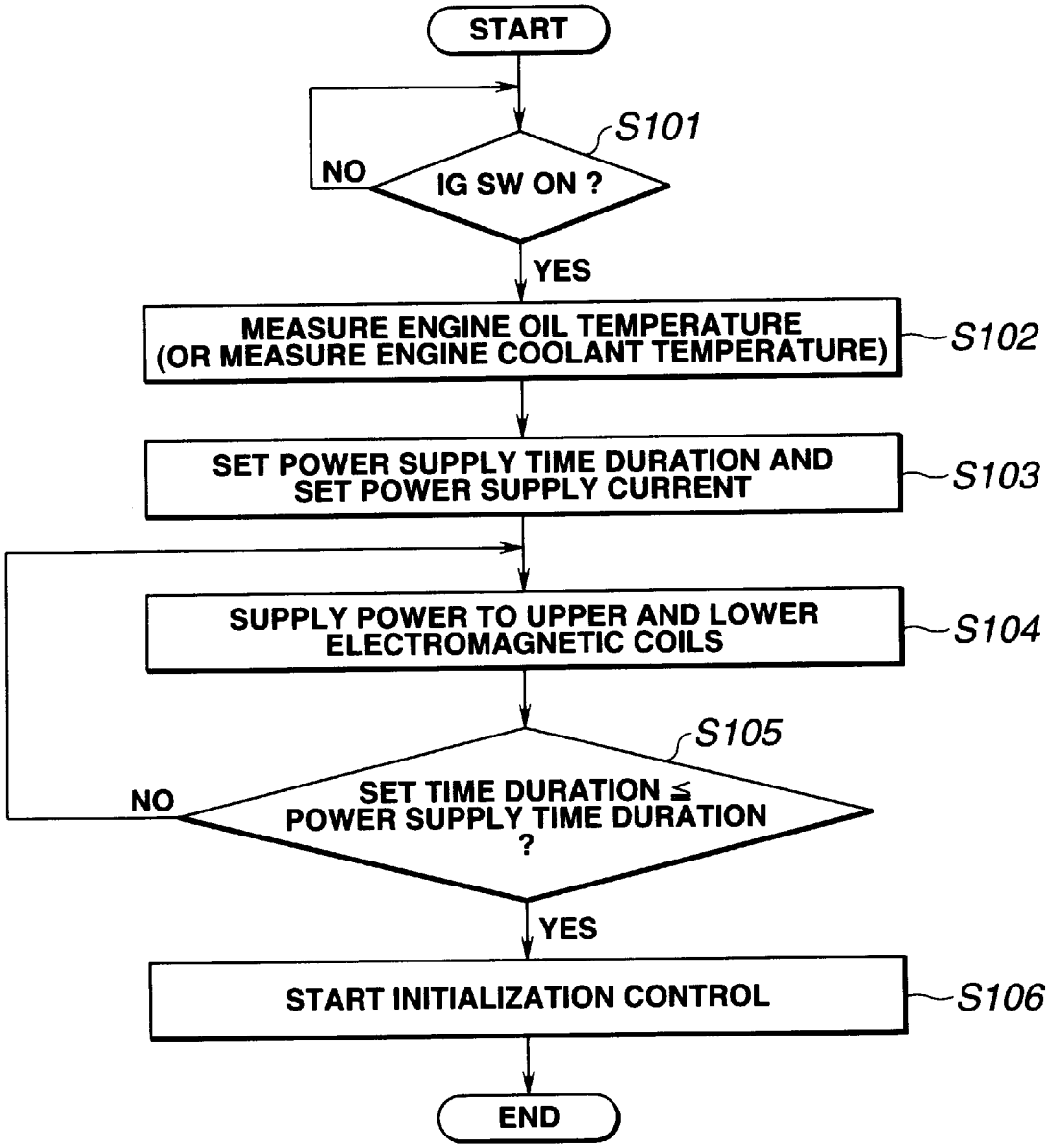
FIG. 3 is an operational flowchart of an example of an initialization operation executed by the controller shown in FIG. 1A during an engine cold start.

FIG. 3 shows an operational flowchart executed by the engine controller 30 shown in FIGS. 1A and 1B.

In FIG. 3, when the engine is started, the initialization operation for the valve assembly 2 is carried out to once close or open the valve body 1 which has been held in the intermediate lift condition.

First, at a step S101, the CPU of the controller 30 determines whether the ignition switch is turned to ON on the basis of the detection signal of an engine ignition switch. If the ignition switch is turned to ON at the step S301, the CPU of the controller 30 measures the engine temperature represented by an engine oil temperature or by an engine coolant temperature.

Next, at a step S103, the CPU of the controller 30 sets a power supply current value and a power supply time duration for the pair of electromagnets 5 and 6 according to the engine temperature.

At a step S104, the CPU of the controller 30 commands to supply the power to the pair of excitation electromagnetic coils 5*b* and 6*b* of these electromagnets 5 and 6 to heat the oil heating structure 23.

At a step S105, the heating operation for the oil heating structure 23 is carried out for the time duration set at the step S103.

When a temperature rise in the engine oil due to the heating at the oil heat structure supplied to the slide portion of each movable member on the valve assembly 2 is finished, the routine goes to a step S106. At the step S106, the engine controller 30 supplies the controlled current to the lower electromagnet 5 and the upper electromagnet 6 to perform the initialization operation. These electromagnets 5 and 6 are alternatingly energized or de-energized to perform the initialization operation.

In the embodiment, the actuator housing 3 whose inner wall portions are contacted on the pair of electromagnets 5 and 6 is provided with the oil passage 21 to which the engine oil is supplied and with the oil outlet holes 22 to the slide portion of each movable member.

Since the oil heating structure 23 is constructed to be enabled to heat the engine oil within the oil passage 21 due to the heat transfer action by means of the power supply to each electromagnet 5 and 6. Prior to the initialization operation of the valve assembly 2 when the engine is started during a cold condition, the pair of upper and lower electromagnets 5 and 6 are heated so that the engine oil within the oil passage 21 is immediately heated to reduce the viscosity of the engine oil in the oil passage 21. Then, the engine oil whose viscosity is reduced is supplied from the oil outlet holes 22 to the slide portion of each movable member so that a lubricativity on the slidable portion of each movable member in the valve assembly 2 can be improved.

Consequently, the initialization operation of the valve assembly 2 can be carried out smoothly and the time required for the initialization can be shortened, and the power consumption of the battery can be saved.

Especially, since, in the embodiment, the oil passage 21 of the housing 3 makes an effective use of the bolt holes 14 into which the assembly bolts 15 are inserted, the oil passage 21 can easily be shortened and the increase in a working labor cost of the housing 3 can be suppressed. Hence, it is more effective in terms of the cost and design.

In addition, since the oil passage 21 is structured in the turn flow configuration circulating the disposed regions of the pair of electromagnets 5 and 6 from the upward direction to the downward direction, a heat receiving area of the circulating oil can be expanded as wide as possible. In addition, since the simultaneous power supply to the electromagnets 5 and 6 causes the heat of the oil so that a temperature promotion effect can be enhanced. The power supply time duration to these electromagnets 5 and 6 can be shortened and the power saving effect on the battery power consumption can be enhanced.

Figure 4:
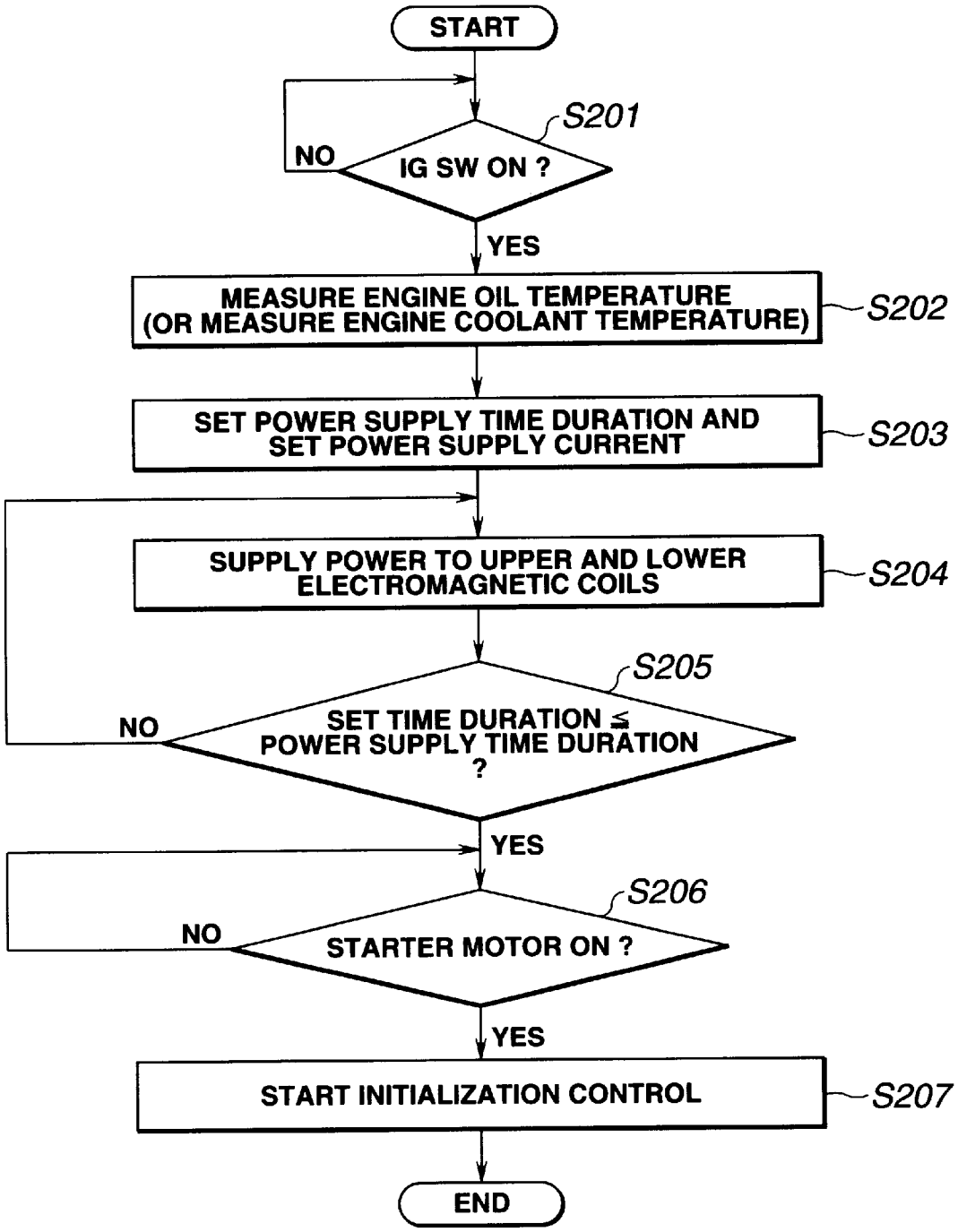
FIG. 4 is an operational flowchart of another example of the initialization operation executed by the controller shown in FIG. 1A during an engine cold start.

FIG. 4 shows another operational flowchart of the control operation during the engine cold condition of the valve assembly 2 by means of the engine controller 30.

In FIG. 4, steps S201 through S205 correspond to the steps S101 through S105 in the embodiment shown in FIG. 3.

After the oil heating structure 23 is heated for the predetermined period of time at a step S205, the routine goes to a step S206 in which the CPU of the controller 30 determined whether the starter motor has been operated or not according to ON and OFF positions of the starter switch. If the starter motor is operated or not, the routine goes to a step S207 to perform the initialization operation of the valve assembly 2.

Hence, since the initialization operation of the valve assembly 2 is carried out after the engine starter motor is operated.

A discharge pressure of an oil pump synchronized with the starter motor is acted upon the oil heated by means of the oil heating structure 23. The discharge pressure of the oil pump causes the engine oil from the oil output holes 22 to be streamed out so that the slide portions of the movable members can be supplied without failure. Hence, the reduction of friction during the initialization operation of the valve assembly 2 can more effectively be carried out.

Figure 5:
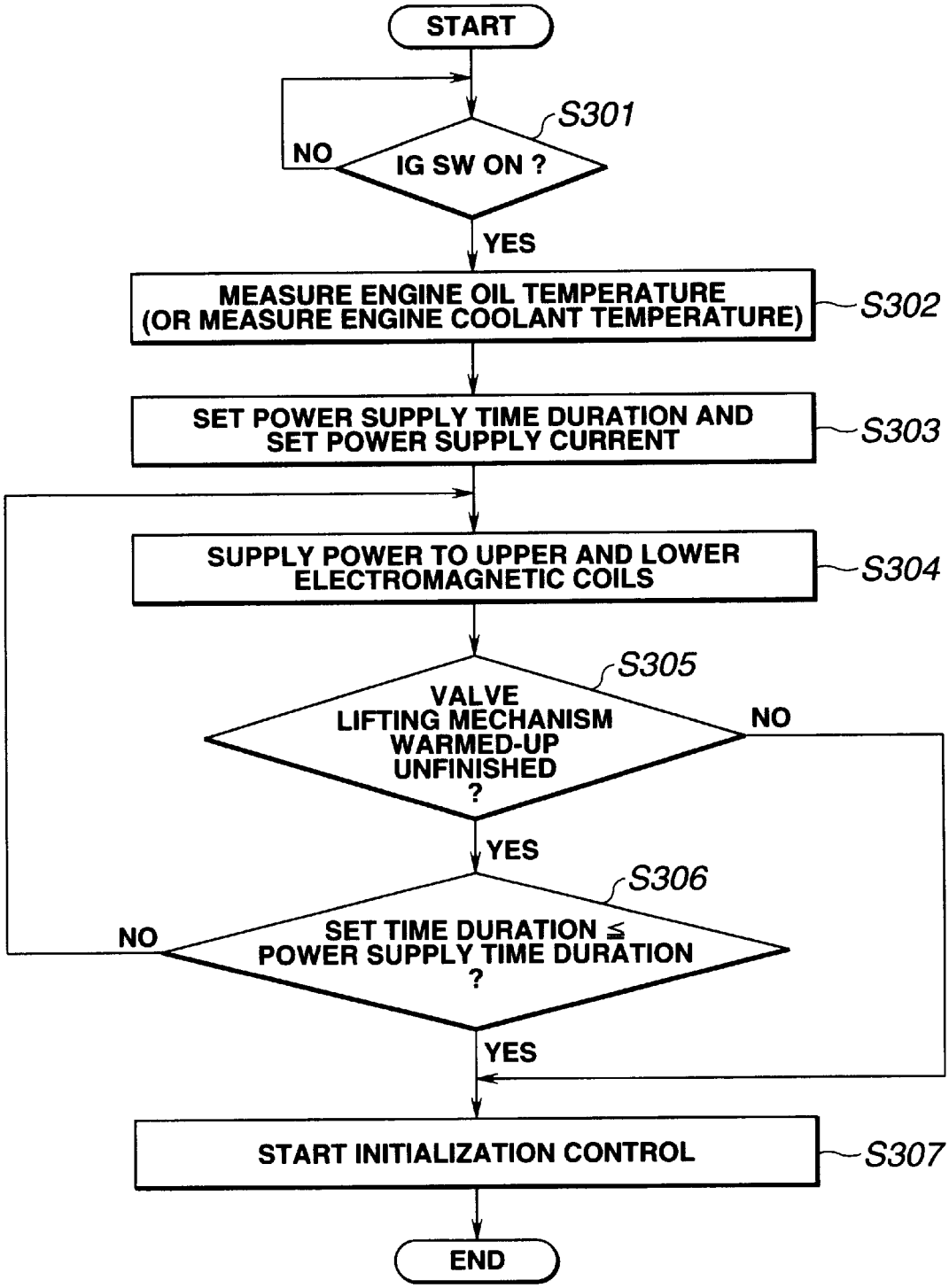
FIG. 5 is an operational flowchart of a still another example of the initialization operation executed by the controller shown in FIG. 1A during the engine cold start.
Figure 6:
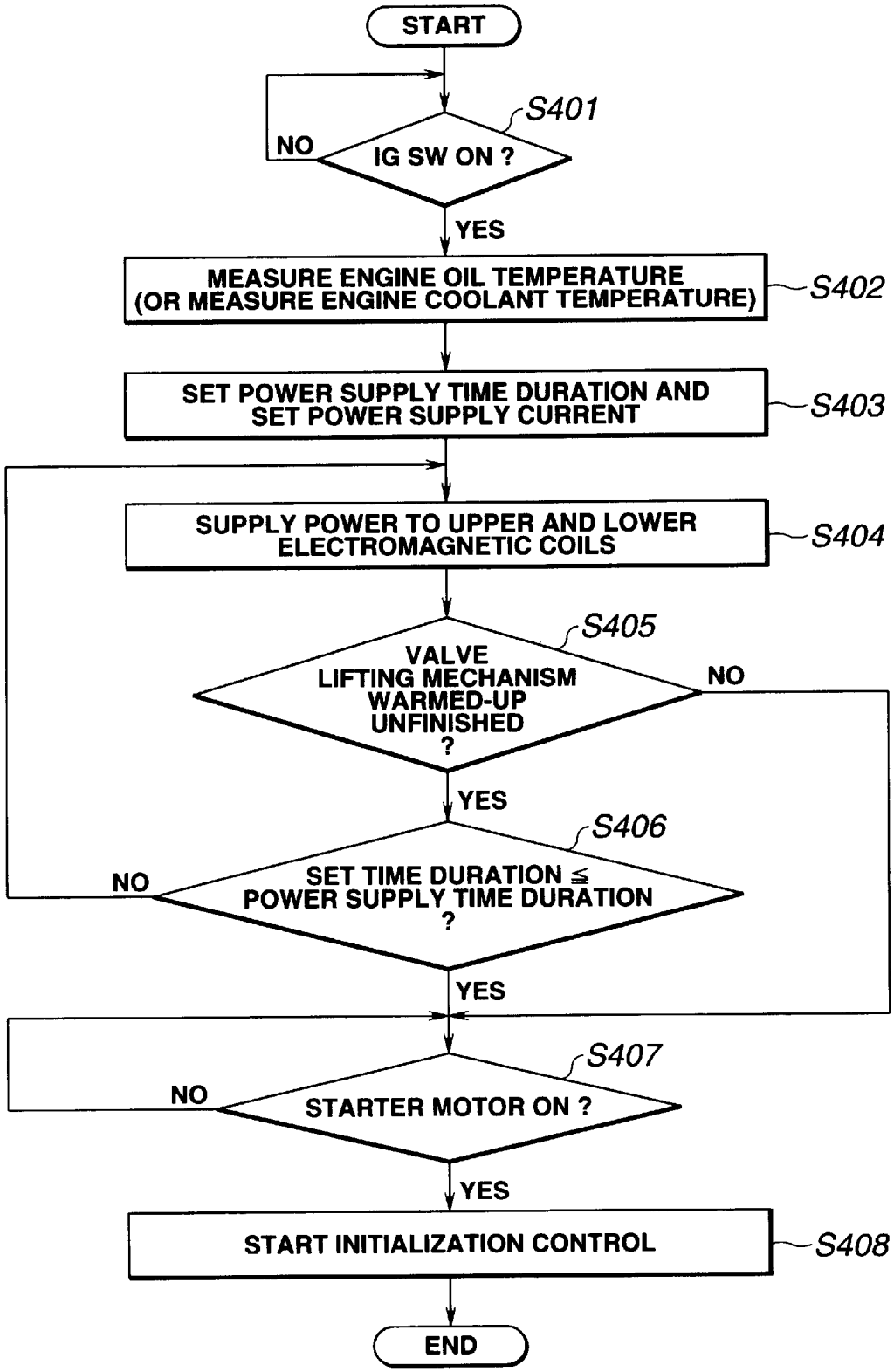
FIG. 6 is an operational flowchart of a still further another example of the initialization operation executed by the controller shown in FIG. 1A during the engine cold start.

FIGS. 5 and 6 show still other examples of the control operations executed by the engine controller 30 during the engine cold start.

Steps S301 through S304 shown in the flowchart of FIG. 5 and steps S306 through S307 correspond to the processes of steps S101 through S104 and steps S105 and S106 described with reference to FIG. 3.

Steps S401 through S404 and steps S406 through S408 shown in the flowchart of FIG. 6 correspond to those of steps S201 through S204 and steps S205 through S207 described in the other example shown in FIG. 4.

At each of the steps S305 and S405 in FIGS. 5 and 6, the CPU of the controller 30 determines whether a warm up of the valve assembly 2 has been finished according to a detection signal from a temperature sensor (not shown) to detect the temperature of each upper and lower electromagnet 5 and 6, respectively.

If the CPU of the controller 30 determines that the warm up of the valve assembly 2 has been finished at either the step S305 or step S405, the processing at the step S607 or step S407 through S408 is executed even in a midway through the time duration set at either the step S303 or step S403.

Hence, in the examples of the control operation shown in FIG. 5 or FIG. 6, the initialization operation can be started immediately when the valve assembly 2 becomes the warm-up finished state at which the engine oil within the oil passage 21 of the housing 3 is sufficiently raised and the viscosity is reduced. Thus, the shortening of the time required for the initialization and the battery power consumption can more effectively be carried out.

The entire contents of a Japanese Patent Application No. Heisei 10-324100 (filed in Japan on Nov. 13, 1998) are incorporated herein by reference.

Although the invention has been described above by reference to certain embodiment of the invention, the invention is not limited to the embodiments described above, Modifications and variations of the embodiments described above will occur to those skilled in the art in light of the above teachings.

The scope of the invention is defined with reference to the following claims.

What is claimed is:

1. An engine valve assembly for an internal combustion engine having a cylinder head, the engine valve assembly comprising:

an engine valve having a valve head portion and a valve axle portion, the valve axle being slidably mounted within the cylinder head;

an armature having an armature axle portion linked to the valve axle portion of the engine valve;

an actuator housing assembled onto the cylinder head;

an electromagnetic actuator disposed within the actuator housing and having a pair of first and second electromagnets, each of the first and second electromagnets being vertically extended with respect to an axis direction of the armature axle portion and being contacted on the actuator housing; and a pair of first and second spring members, the first spring member biasing the engine valve toward a valve open direction and the second spring member biasing the engine valve toward a valve closure direction so that the engine valve is open and closed according to a cooperation of forces exerted by the pair of first and second electromagnets and the pair of first and second spring members, the actuator housing taking an engine oil structure having at least one oil passage through which an engine oil external to the valve assembly is supplied to the actuator housing and at least one oil outlet hole through which the engine oil in the oil passage is caused to flow onto a slidable portion of movable members of the valve assembly of the valve axle portion of the engine valve and the armature and taking an oil heating structure, the oil heating structure being enabled to heat the oil within the oil passage due to a heat transfer action thereof by means of a simultaneous power supply to the pair of first and second electromagnets before an initialization operation of the valve assembly.

2. An engine valve assembly for an internal combustion engine having a cylinder head as claimed in claim 1, wherein the actuator housing includes a plurality of bolts, each bolt for the actuator housing to be assembled onto the cylinder head, and bolt holes, each bolt hole being extended through the actuator housing and cylinder head and wherein the oil passage structure is extended along spaces between peripheral surfaces of the respective bolts and bolt holes and the oil heating structure is extended along the oil passage.

3. An engine valve assembly for an internal combustion engine having a cylinder head as claimed in claim 1, wherein the oil passage is circulated in a turn flow structure such that the engine oil is circulated from an upper region of the actuator housing contacted on the first electromagnet to a lower region of the actuator housing contacted on the second electromagnet.

4. An engine valve assembly for an internal combustion engine having a cylinder head as claimed in claim 1, wherein the oil heating structure transmits the heat from the pair of electromagnets when the power is simultaneously supplied to the pair of first and second electromagnets.

5. An engine valve assembly for an internal combustion engine having a cylinder head as claimed in claim 1, wherein the initialization operation of the valve assembly is carried out after the engine starter motor is operated.

6. An engine valve assembly for an internal combustion engine having a cylinder head as claimed in claim 2, wherein the actuator housing includes a first housing in which the first spring member is housed and a second housing in which the pair of first and second electromagnets are housed, each of side peripheral end surfaces of the first electromagnet and of the second electromagnet being contacted on an inner wall of the second housing, each bolt hole being extended between an outer wall and the inner wall of the second housing along each side peripheral end of the first and second electromagnets.

7. An engine valve assembly for an internal combustion engine having a cylinder head as claimed in claim 6, wherein a communication hole is extended in a partitioning wall of the actuator housing to partition the first housing and second housing, the communication hole being interposed between each of the pair of the oil passages provided between the spaces on the bolt holes and an upper peripheral end surface of the first electromagnet which is contacted on the partitioning wall.

8. An engine valve assembly for an internal combustion engine having a cylinder head as claimed in claim 7, wherein the second spring member is housed within a recess of the cylinder head, the pair of first and second electromagnets are spaced apart from each other within the second housing by means of a distance block, an armature main body being extended vertically from the axle portion thereof being rested on an upper peripheral surface of the second electromagnet which is faced against a lower peripheral end surface of the first electromagnet with a predetermined space when no power supply is received by the pair of first and second electromagnets or the simultaneous power supply is carried out to the pair of the first and second electromagnets so that the engine valve body is placed at an intermediate position between an open position and a close position with respect to a valve seat of the cylinder head.

9. An engine valve assembly for an internal combustion engine having a cylinder head as claimed in claim 8, wherein the oil passage is connected to an engine oil passage extended in the cylinder head and the oil outlet hole is provided on the communication hole to face toward the armature axle portion, on the distance block to face toward the armature axle portion, and on a lower portion of the second housing to face toward the armature axle portion and the valve axle portion at the recess portion and at a lower peripheral end surface of the second electromagnet.

10. An engine valve assembly for an internal combustion engine having a cylinder head as claimed in claim 9, further comprising a controller connected to each of the first and second electromagnets, the controller determining whether an engine ignition switch is turned on, measuring an engine oil temperature, setting a power supply time duration for which the simultaneous power supply to each of the first and second electromagnets is carried out and a power supply current by which the simultaneous power supply of each of the pair of electromagnets is carried out according to the measured engine oil temperature, and supplying the power supply current to the pair of first and second electromagnets simultaneously for the set power supply time duration.

11. An engine valve assembly for an internal combustion engine having a cylinder head as claimed in claim 9, further comprising a controller connected to each of the first and second electromagnets, the controller determining whether an engine ignition switch is turned on, measuring an engine oil temperature, setting a power supply time duration for which the simultaneous power supply to each of the pair of first and second electromagnets is carried out and a power supply current by which the simultaneous power supply of each of the first and second electromagnets is carried out according to the measured engine oil temperature, supplying the power supply current to the pair of first and second electromagnets simultaneously for the set power supply time duration, determining whether the engine starter motor is turned on when the power supply time duration is ended, and starting the initialization operation when determining that the engine starter motor is turned on.

12. An engine valve assembly for an internal combustion engine having a cylinder head as claimed in claim 10, wherein the controller determines whether a warm-up of the engine valve assembly is finished while the simultaneous power supply to each of the first and second electromagnets is carried out and starts the initialization operation when the warm-up of the engine valve assembly is finished.

13. An engine valve assembly for an internal combustion engine having a cylinder head as claimed in claim 11, wherein the controller determines whether a warm-up of the engine valve assembly is finished while the simultaneous power supply to each of the first and second electromagnets is carried out and starts the initialization operation when the warm-up of the engine valve assembly is finished and when the engine starter motor is turned on.

14. An engine valve assembly for an internal combustion engine having a cylinder head as claimed in claim 11, wherein the controller supplies the power supply to either the first or second electromagnet so that the valve body portion is placed at the close position or open position to carry out the initialization operation.

15. An engine valve assembly for an internal combustion engine having a cylinder head as claimed in claim 14, wherein the engine valve is at least one of an intake valve and an exhaust valve.

* * * * *